United States Patent [19]

Molfetta et al.

[11] Patent Number: 4,837,570

[45] Date of Patent: Jun. 6, 1989

[54] IGNITION DELAY VAPOR EXPULSION MODULE

[76] Inventors: Anthony J. Molfetta, 4 Prince Charming Rd., Nesconset, N.Y. 11767; William H. Sawicki, 3258 Philip Ave., Bronx, N.Y. 10465

[21] Appl. No.: 152,162

[22] Filed: Feb. 4, 1988

[51] Int. Cl.[4] ..... G08B 23/00; B63J 2/06

[52] U.S. Cl. ..... 340/984; 114/211; 123/198 D; 340/632

[58] Field of Search ..... 340/984, 53, 64, 632, 340/634, 661; 114/211; 440/1, 2; 98/1; 123/198 D, 179 B; 307/9

[56] References Cited

U.S. PATENT DOCUMENTS

| | | | |
|---|---|---|---|
| 3,292,568 | 12/1966 | Morrell | 440/1 |
| 3,315,584 | 4/1967 | Van Ranst | 340/632 |
| 3,489,912 | 1/1970 | Hoffman, Jr. | 114/211 |
| 3,760,394 | 9/1973 | Fletcher et al. | 340/523 |
| 3,789,231 | 1/1974 | Hayden | 340/632 |
| 3,886,535 | 5/1975 | Cirincione | 340/634 |
| 3,948,202 | 4/1976 | Yoshikawa | 340/632 |
| 3,951,091 | 4/1976 | Doench | 114/211 |
| 4,235,181 | 11/1980 | Stickney | 340/527 |
| 4,250,829 | 2/1981 | Stephens, Jr. | 340/632 |
| 4,473,025 | 9/1984 | Elliott | 114/211 |

*Primary Examiner*—Joseph A. Orsino
*Assistant Examiner*—Brent A. Swarthout
*Attorney, Agent, or Firm*—Richard L. Miller

[57] ABSTRACT

An ignition delay vapor expulsion module is provided for accessory use with a boat. When activated, the module energizes an accessory ventilating fan for a predetermined time period. After this time period the fan automatically stops and the ignition is enabled so that the operator can start the engine. By preventing the operator from activating the ignition either before or during the ventilation process, explosive fumes may be safely and completely ventilated. An electronic timer and latching relays are used to implement the timing/-switching functions.

4 Claims, 1 Drawing Sheet

| OPERATING CYCLE | RELAY I | RELAY II | RELAY III | RELAY IV | RELAY V | RELAY VI | FAN | FAN LED | IGNITION ENABLE | IGNITION ENABLE LED |
|---|---|---|---|---|---|---|---|---|---|---|
| S1 OFF | 0 | 0 | 0 | 0 | 0 | 0 | 0 | 0 | 0 | 0 |
| S1 ON | 0 | 0 | 0 | 0 | 0 | 0 | 0 | 0 | 0 | 0 |
| S2 MOMENT. DEPRESSED | 0 | 1 | LATCHED 1 | LATCHED 1 | 0 | 0 | 1 | 1 | 0 | 0 |
| AFTER PRESET DELAY | 1 | 0 | STILL LATCHED 1 | STILL LATCHED 1 | LATCHED 1 | LATCHED 1 | 0 | 0 | 1 | 1 |
| S1 OFF | 0 | 0 | UN-LATCHED 0 | UN-LATCHED 0 | UN-LATCHED 0 | UN-LATCHED 0 | 0 | 0 | 0 | 0 |

TRUTH TABLE (0 = OFF, 1 = ON)

IGNITION DELAY VAPOR EXPULSION MODULE

BACKGROUND OF THE INVENTION

The present invention relates generally to the field of explosive ventilation and safety and, more specifically to safety devices for water craft.

At the present state of the art the operator of a boat is warned by both boat manufacturers as well as by safety regulatory agencies to thoroughly ventilate the engine compartment of the bilge to eliminate explosive residue vapors. Five minutes is typically required depending upon the volume to be ventilated and the size and efficiency of the ventilating equipment. If the operator starts the engine without sufficient ventilation, and explosion may result with attendant loss of life or limb. A system that would automatically ventilate the bilge and disable the ignition until ventilation has been completed would prevent such catastrophes from occuring.

A number of inventions have been proposed which relate somewhat tangentially to this problem. D. Ravey (U.S. Pat. No. 4,125,833) provides a sequence switching circuit with latching alarm, J. Fletcher (U.S. Pat. No. 3,760,394) provides an event sequence detector, and K. Uota (U.S. Pat. No. 3,902,074) provides an engine interlocking device; however, none of these addresses the problem of sequencing a ventilating fan with an engine ignition, and are therefore outside the scope of the instant invention.

SUMMARY OF THE INVENTION

It is, therefore, a primary object of the present invention to provide an ignition delay vapor expulsion module that prevents an operator from starting the engine of a power boat until the boat is properly vented.

Another object is to provide an ignition delay vapor expulsion module that when activate automatically initiates operation of an accessory ventilating fan for a predetermined period of time.

A still further object is to provide an ignition delay vapor expulsion module that prevents the operation of the ignition until the end of the predetermined ventilation period.

A yet still further object is to provide an ignition delay vapor expulsion module that does not interfere with the normal operation of the boat once the ventilation period is over.

A still further object is to provide an ignition delay vapor expulsion module that is easy to install, simple and inexpensive to manufacture, and easy to use.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figures 1, 2:
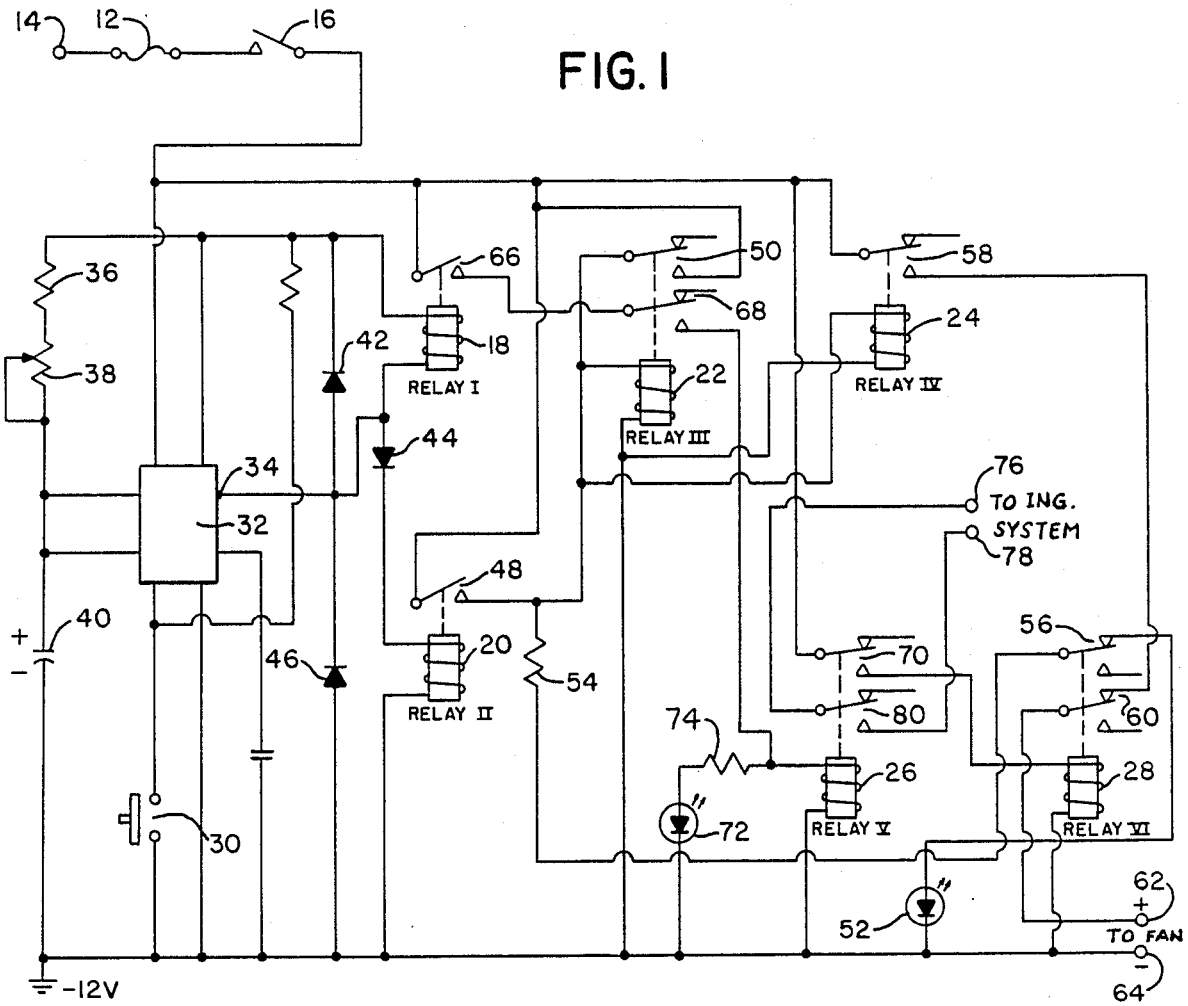
FIG. 1 is an electronic schematic diagram of the invention.
FIG. 2 is a truth table diagram illustrating the cooperation between the relays, switches, indicators, and the accessory elements of the invention.

Both the schematic diagram FIG. 1 and the truth table diagram FIG. 2 may be used to understand the operation of the invention.

Fuse 12 protects the electrical system of the boat, input at 14, from a short circuit of the invention, When the boat is not in use switch 16, typically a toggle switch is turned off.

To start the ventilation/ignition sequence switch 16 is turned on. At this time Relay I (18), Relay II (20), Relay III (22), Relay IV (24), Relay V (26), and Relay VI (28) are all in their deenergized positions as shown.

To initiate the ventilation/ignition sequence momentary contact activation switch 30 is depressed and released. This pulse resets a timer circuit, typified by the ubiquitous 555 chip 32. The transition time to go from a zero to a one at output pin 34 is determined by the time constant of the RC circuit formed by fixed resistor 36, variable resistor 38, and capacitor 40 according to the formula $T=RC$, where T is time in seconds, R is resistance in ohms, and C is capacitance in farads. A typical time constant for this circuit is five minutes, however, this may be adjusted by changing the resistance setting of variable resistor 38.

When switch 30 is activated, pin 34 on timer chip 32 goes to one activating relay II. Note diodes 42, 44, and 46 are steering diodes that permit Relay I (18) and Relay II (20) to operate independently. The closure of the contacts 48 on Relay II (20) energizes both Relay III (22) and Relay IV (24), which stay latched due to the use of the latching feature at contacts 50 of Relay II (22). At the same time LED fan indicator 52 is activated via resistor 54 and contacts 56. The accessory ventilation fan is also activated via contacts 58 and contacts 60. Fan connection 62 is connected directly in parallel with the existing ventilating fan switch on the boat, so that the fan may always still be turned on independently when desirable.

At the end of the predetermined time interval, the output of the timer chip 34 goes to zero activating Relay I (18) and deactivating Relay II (20). Note that even though Relay II (20) is deactivated, relay III (22) and Relay IV (24) remain latched. Relay I (18) activates Relay V (26) and Relay VI (28) via contacts 66 and contacts 68. These relays also latch due to the use of the latching feature at contacts 70 of Relay V (26). At the same time LED ignition enable indicator 72 is activated via resistor 74. Ignition system connections 76 and 78 are connected in series with the existing ignition switch. Relay VI (26) contacts 80 permit the existing ignition system to operate once the five-minute ventilation period has ended. Importantly, the ignition is disabled both before and during the ventilation period.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. An ignition delay vapor expulsion module comprising a switching circuit for connection to an accessory power source, an accessory ventilating fan and an accessory ignition switch, such that when said switching circuit is activated, said ventilating fan is powered by said accessory power source for a predetermined time interval, after which said ventilating fan ceases to operate and said ignition switch is enabled, and indicating means for signalling the operation of said ventilating fan and the enabling of said ignition switch, wherein said switching circuit comprises an electronic timing device whose output is a zero when reset and whose output becomes a one at the end of some predetermined time interval; a first switching device that is activated only when said output is a one; a second switching device that is activated only when said output is a zero; a power switch that applies power to said module; a momentary contact activation switch that activates said electronic timer; a first latching/switching device energized by said second switching device; and a second latching/switching device energized by said first switching device; wherein after said power switch is turned on; and said activation switch is momentarily depressed, said second switch device causes said first latchings/switching device to energize said accessory ventilating fan and said fan signalling means; and wherein after said predetermined time interval said first switch device causes said second latching/switching device to enable said accessory ignition switch and means for signalling enabling of said ignition switch, while disabling said accessory ventilating fan and said fan signalling means.

2. An ignition delay vapor expulsion module, as recited in claim 1, wherein said means for signalling enabling of said ignition switch are light emitting diodes.

3. An ignition delay vapor expulsion module, as recited in claim 1, wherein said means for signalling enabling of said ignition switch are audible alarms.

4. An ignition delay vapor expulsion module, as recited in claim 1, wherein said switching devices and said latching/switching devices are electromechanical relays.

* * * * *